US006068153A

United States Patent [19]

Young et al.

[11] Patent Number: 6,068,153

[45] Date of Patent: May 30, 2000

[54] DISPENSING COVER FOR FIBERBOARD DRUM

[75] Inventors: Christopher J. Young, Port Washington, N.Y.; Brooks R. Markert, Harwinton, Conn.

[73] Assignee: C&N Packaging, Inc., Wyandanch, N.Y.

[21] Appl. No.: 09/242,912

[22] PCT Filed: Aug. 27, 1997

[86] PCT No.: PCT/US97/15085

§ 371 Date: Feb. 25, 1999

§ 102(e) Date: Feb. 25, 1999

[87] PCT Pub. No.: WO98/09881

PCT Pub. Date: Mar. 12, 1998

Related U.S. Application Data

[60] Provisional application No. 60/025,097, Sep. 3, 1996.

[51] Int. Cl.[7] ..... B65D 51/22; B65D 83/06

[52] U.S. Cl. ..... 220/254; 220/258; 220/259; 222/480; 222/541.5; 222/542

[58] Field of Search ..... 220/254, 256, 220/258, 259, 611, 614, 620, 780, 781, 784, 787, 789, 790, 375; 222/542, 541.5, 543, 565, 480; 229/125.08, 125.09, 125.13, 5.5

[56] References Cited

U.S. PATENT DOCUMENTS

| | | |
|---|---|---|
| D. 277,724 | 2/1985 | Daenen et al. . |
| D. 278,115 | 3/1985 | Leininger . |
| D. 319,786 | 9/1991 | Rayner . |
| D. 348,834 | 7/1994 | Wardell, Jr. . |
| 2,764,199 | 9/1956 | Tupper . |
| 3,095,995 | 7/1963 | Foster . |
| 3,122,287 | 2/1964 | Makowski . |
| 3,297,192 | 1/1967 | Swett . |
| 3,675,812 | 7/1972 | Foster . |
| 4,059,201 | 11/1977 | Foster . |
| 4,491,252 | 1/1985 | Schmidt et al. . |
| 4,724,977 | 2/1988 | Cleevely et al. . |
| 4,759,478 | 7/1988 | Richardson et al. . |
| 5,211,305 | 5/1993 | Horton . |
| 5,397,013 | 3/1995 | Adams et al. . |

FOREIGN PATENT DOCUMENTS

| | | |
|---|---|---|
| 771996 | 11/1967 | Canada . |

*Primary Examiner*—Nathan J. Newhouse
*Attorney, Agent, or Firm*—Hoffman & Baron, LLP

[57] ABSTRACT

A dispensing cover (10) for use with a first fiberboard drum (14) includes a main portion (50), a skirt portion (52) and a skirt portion extension (54). The drum has a continuous upstanding drum wall (44) with a wall edge (46) having a rolled-in lip (16). The wall edge (16) forms a perimeter of a cover receiving opening (48). Main portion (50) is sized to fit within the perimeter of cover receiving opening (48). Skirt portion (52) is secured to main portion (50) and extends generally parallel to upstanding drum wall (44). Skirt portion extension (54) is secured to skirt portion (52) and forms a cavity (56) for receiving rolled-in lip (16) of drum (14). At least one barb (12) can be provided to secure cover (10) to fiberboard drum (14). A resealable lid (20) and a dispensing cover seal (30) can also be provided. The seal (30) prevents undesirable retention of product by the rolled-in lip (16). A stack alignment lip (42) can be provided to allow stacking of adjacent drums (14), (36).

19 Claims, 8 Drawing Sheets

DISPENSING COVER FOR FIBERBOARD DRUM

This application claims benefit of Provisional Application No. 60/025,097 Sep. 3, 1996.

BACKGROUND OF THE INVENTION

1. Field of the Invention

The present invention relates to covers, and more particularly relates to a dispensing cover for a fiberboard drum.

2. Description of the Prior Art

Current packaging applications frequently require containers for granular products which may be dispensed from the containers. One current type of package includes a rectangular fiberboard drum which has a top sealed off with an injection molded cover. The cover is attached to the drum with tape.

In order to dispense product from the container, the consumer removes the tape to detach the cover. Frequently, this results in the tape peeling off part of the label of the container. The is both aesthetically undesirable, and results in removal of some of the lettering or other information on the box. Further, once the tape has been removed, there is no way to securely reseal the container other than re-taping it. The current type of cover design is friction fit to the outside of the container, and while it provides adequate protection from the elements, it will come off when the box is knocked over (unless re-taped), thus resulting in spillage of the contents.

New legislation requires certain packages to evacuate a substantial fraction of the product before disposal. Current designs employ a rolled-in lip on the fiberboard drum. This inhibits evacuation of the package, and may result in inability to comply with the new legislation.

Furthermore, the taping operation employed with current technology designs is very labor intensive. Finally, during shipment, drums are stacked on a skid. A corrugated sheet must be placed between the layers of stacked prior art drums. Elimination of these sheets would result in a cost savings.

In view of the deficiencies of prior art dispensing covers, there is a need for a dispensing cover which can be securely attached to a fiberboard drum. Furthermore, there is a need for a dispensing cover which prevents retention of product by the rolled-in lip of the fiberboard drum. Yet further, there is a need for a dispensing cover which can be stacked without the use of a corrugated sheet. In every case, it will be desirable if the new dispensing cover can be opened to dispense product and then securely resealed.

OBJECTS AND SUMMARY OF THE INVENTION

It is an object of the present invention to provide a dispensing cover for a fiberboard drum which can be securely attached to the fiberboard drum without a separate taping operation.

It is another object of the present invention to provide a dispensing cover for a fiberboard drum which inhibits undesirable retention of product in the rolled-in lip of the fiberboard drum.

It is yet another object of the present invention to provide a dispensing cover for a fiberboard drum which can be stacked without use of a corrugated sheet.

It is a further object of the present invention to provide a dispensing cover for a fiberboard drum which can be opened to dispense product and then resealably closed.

One form of the present invention eliminates the taping operation by employing a top cover which locks into the top of the box by means of barbs which engage the rolled-in lip of the box. In addition to eliminating the taping operation, this design provides a cover which is permanently attached to the box, thereby overcoming the spillage problem.

Furthermore, in the present invention, a die-cut flange may optionally be attached to the bottom of the cover, to provide a particle seal around the rolled-in lip, thus preventing undesirable retention of product in the rolled-in lip, and enabling compliance with the new legislation requirements for substantial product evacuation.

The present invention can also be equipped with a resealable cover having a lid which may optionally be attached to the cover with a flexible strap. Thus, the consumer can dispense from the resealable lid without removing the entire cover.

Finally, the present invention can be configured to be self-stacking in that the top of the cover can be provided with a stacking rim which engages a hollow on the bottom of a container to be positioned in a higher layer.

In accordance with one form of the present invention, a dispensing cover is provided for use with a first fiberboard drum which has a continuous upstanding drum wall with a wall edge having a rolled-in lip. The wall edge forms a perimeter of a cover-receiving opening. The dispensing cover includes a main portion which is sized to fit within the perimeter of the cover-receiving opening. The dispensing cover also includes a skirt portion which is secured to the main portion and which extends generally parallel to the upstanding drum wall. The dispensing cover further includes a skirt portion extension which is secured to the skirt portion and which forms a cavity for receiving the rolled-in lip of the first fiberboard drum. Finally, the dispensing cover also includes at least one barb which is secured to the skirt portion and which extends outwardly therefrom. The barb has an angled surface which rides up and over the rolled-in lip of the first fiberboard drum as the dispensing cover is inserted in the first fiberboard drum. The barb has a generally straight surface which traps the rolled-in lip of the first fiberboard drum in the cavity of the skirt portion when the dispensing cover is fully inserted in the first fiberboard drum.

The dispensing cover can be configured with a lid-receiving aperture and can include a lid which is optionally flexibly secured to the dispensing cover and which is configured to be resealably secured in the aperture. Furthermore, the dispensing cover can include a dispensing cover seal formed of a flexible material which is secured to the main portion. The seal can have an outer perimetric seal edge which sealingly abuts the continuous upstanding drum wall when the dispensing cover is inserted in the first fiberboard drum. The seal can be positioned to impede retention, by the rolled-in lip, of product contained in the first fiberboard drum.

Furthermore, the dispensing cover can be equipped with a stack alignment lip which extends upwardly from the main portion to engage rolled-in edges at the floor of a second fiberboard drum when the second fiberboard drum is stacked on top of the dispensing cover. The second fiberboard drum can be of the type having a recessed floor retained by rolled-in edges.

In various forms of the invention, the features of a barb; a dispensing cover seal; a lid and lid-receiving aperture; and a stack alignment lip can each individually be provided alone, or in any desired combination with the other features.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENT

Figure 3:
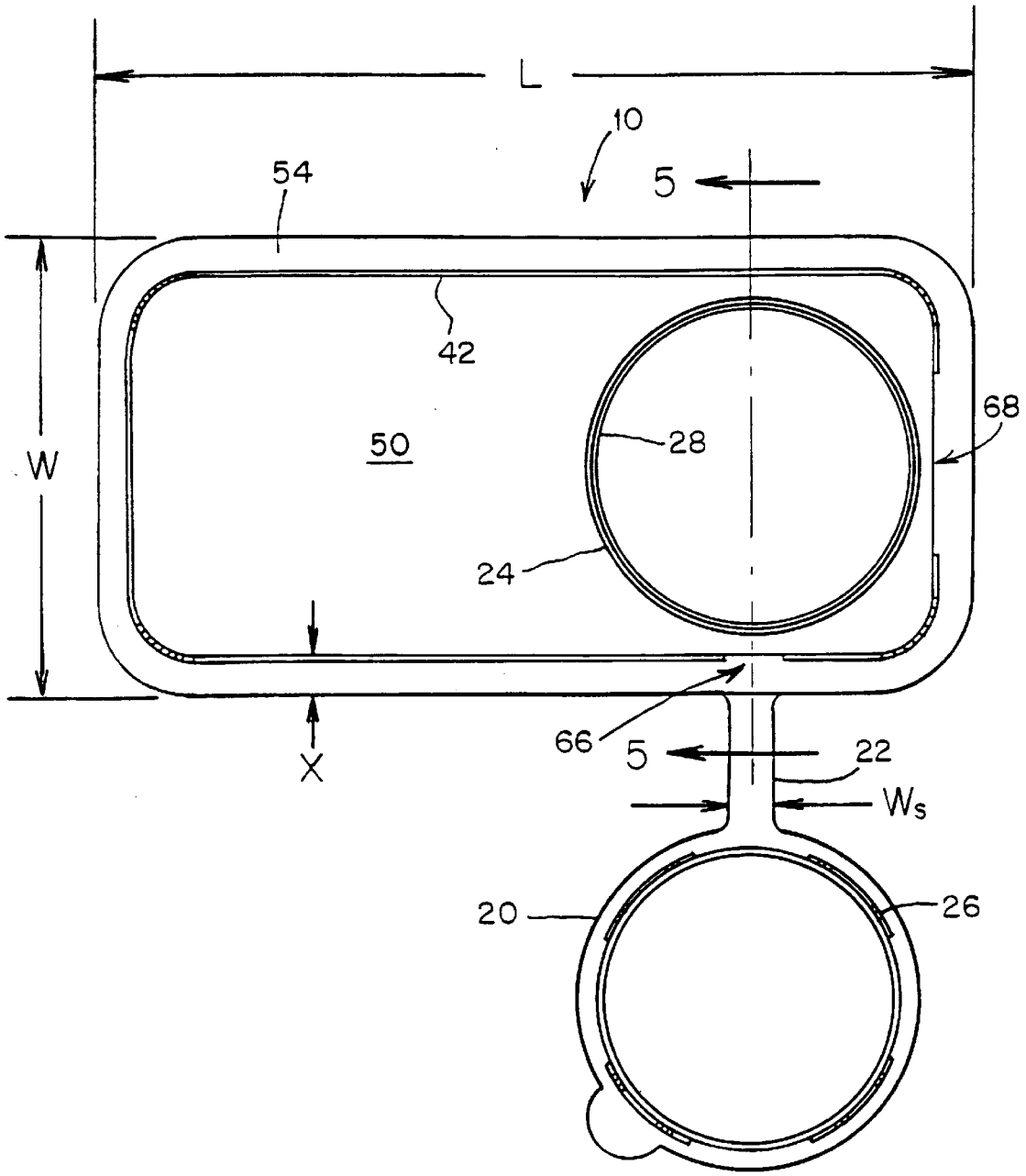
FIG. 3 is a top plan view of a dispensing cover in accordance with the present invention.
Figure 4:
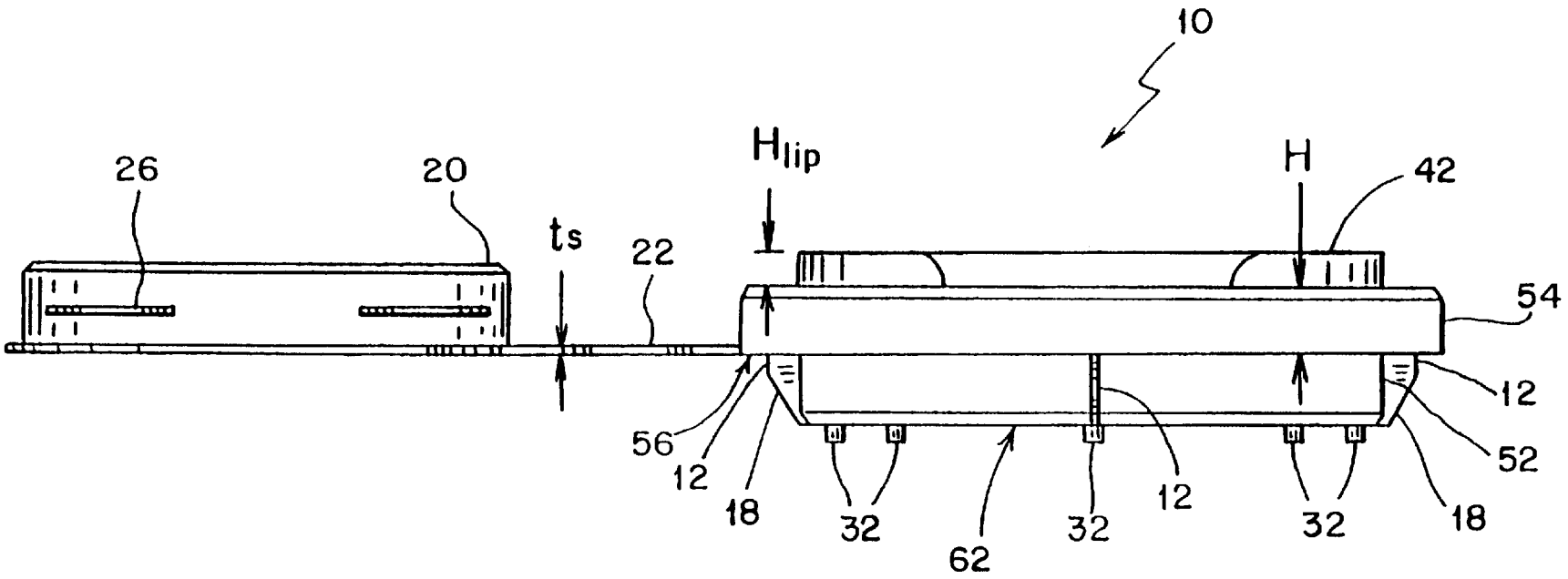
FIG. 4 is a side elevation view of a dispensing cover in accordance with the present invention.
Figure 5:
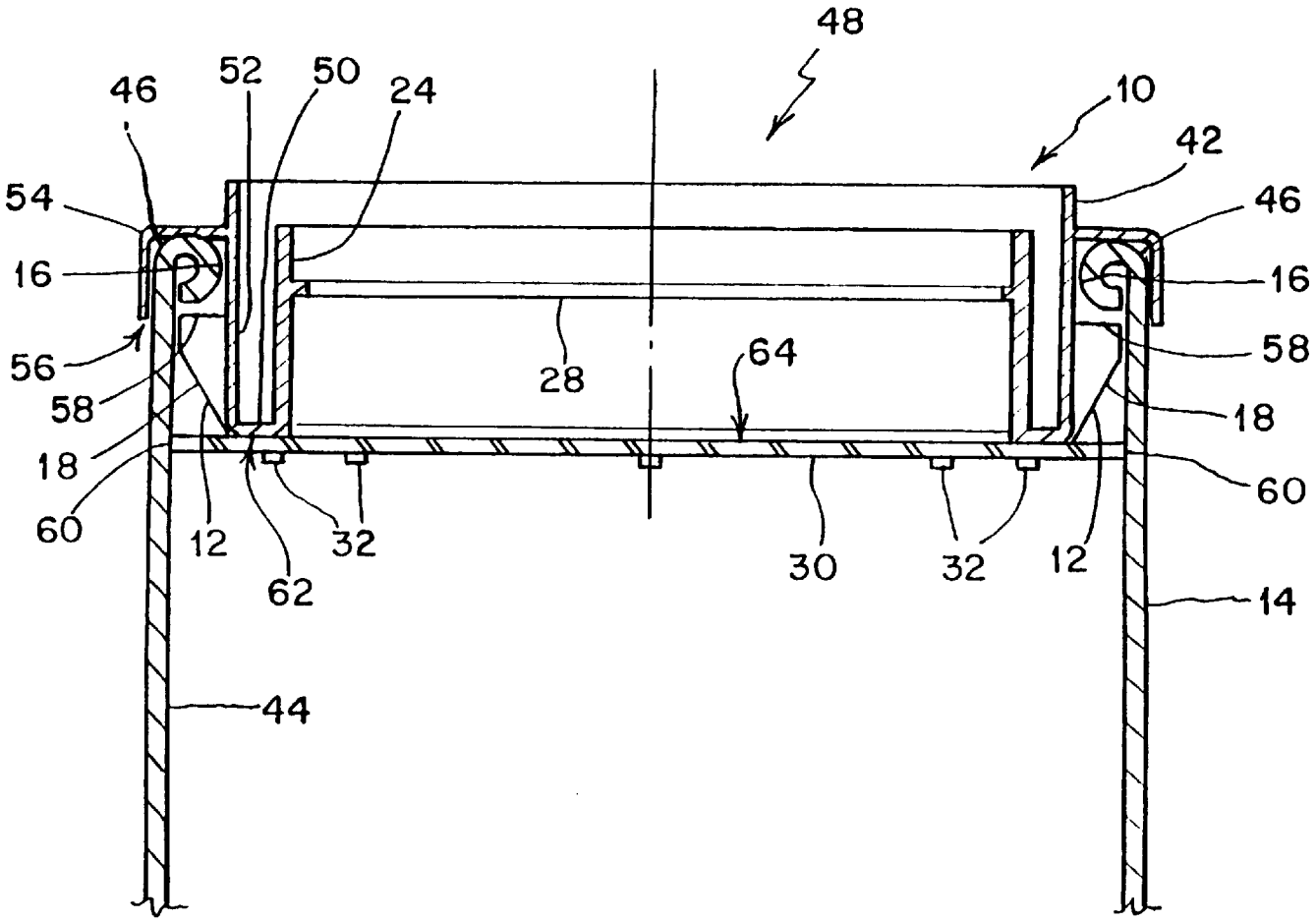
FIG. 5 is a partial cross-sectional view taken along line 5—5 of FIG. 3 showing retention and sealing features of the present invention.

Referring initially to FIGS. 1–5, a dispensing cover in accordance with the present invention is depicted, and is designated generally as 10. Cover 10 is intended for use with a first fiberboard drum or box 14 (as best seen in FIG. 5). First fiberboard drum 14 has a continuous upstanding drum wall 44 with a wall edge 46 having a rolled-in lip 16. Wall edge 46 forms a perimeter of a cover-receiving opening 48.

Dispensing cover 10 includes a main portion 50 which is sized to fit within the perimeter of the cover-receiving opening 48. Dispensing cover 10 also includes a skirt portion 52 which is secured to the main portion 50 and which extends generally parallel to the upstanding drum wall 44. Dispensing cover 10 further includes a skirt portion extension 54 which is secured to skirt portion 52 and which forms a cavity 56 for receiving the rolled-in lip 16 of the first fiberboard drum 14. It will be appreciated that main portion 50 and skirt portion 52 form a spill-containing well. It will also be appreciated that skirt portion extension 54 (or any of the other elements) may be given any shape which is pleasing to the eye; for example, extension 54 could include a segment of a circle, ellipse, etc.

Dispensing cover 10 can include at least one barb 12 which is secured to skirt portion 52 and which extends outwardly therefrom. Barb 12 has an angled surface 18 which rides up and over the rolled-in lip 16 of first fiberboard drum 14 as dispensing cover 10 is inserted in first fiberboard drum 14. Barb 12 preferably also includes a generally straight surface 58 which traps the rolled-in lip 16 of the first fiberboard drum 14 in cavity 56 of skirt portion extension 54 when dispensing cover 10 is fully inserted into the first fiberboard drum 14. Note that barb 12 can be directly secured to skirt portion 52, as shown in the figures, or can be indirectly secured via fastening to another component of cover 10 which is in turn secured to skirt portion 52.

It will be appreciated that a plurality of barbs 12 are preferably provided. Barbs 12 permit cover 10 to be securely and permanently retained in place, without taping. This permanent attachment also avoids the spillage problem common in the prior art.

If desired, dispensing cover 10 can be made resealable via a lid 20 which is optionally flexibly secured to dispensing cover 10, such as by flexible strap 22. Lid 20 can also be separate from cover 10. Main portion 50 can be provided with a lid-receiving aperture, such as that formed by lid-receiving projection 24. Lid 20 can be configured to be resealably secured in the aperture of lid-receiving projection 24 by any suitable means, such as, for example a friction fit or via engaging lips 26, 28. Screw threads or a bayonet mount could also be used. In this case, instead of flexible strap 22, a bead chain arrangement allowing for rotation of lid 20 could be used to secure lid 20 to cover 10, if desired. Thus, using the present invention, it is possible to dispense from the package without removing the entire cover. Although depicted as round, lid 20 and projection 24 can be given any pleasing shape, for example, elliptical, generally rectangular, and the like. With reference to FIGS. 3 and 4, strap 22, in a first configuration, can have a width $W_s$ of about 0.625 inches (about 15.9 mm) and a thickness $t_s$ of about 0.040 inches (about 1 mm). In a second preferred embodiment, width $W_s$ can be about 3/16 inch (about 4.8 mm) and thickness $t_s$ can be about 1/16 inch (about 1.6 mm). The width $W_s$ and thickness $t_s$ of strap 22 should be selected to permit stacking of additional fiberboard drums on top of stack alignment lip 42, as discussed below. While a thinner strap, i.e., one with a lower value of $t_s$ will interfere less with stacking, it has also been found that a strap 22 with a lower value of $W_s$, i.e., less width, also aids in stacking. This appears to be due to the fact that the strap with reduced width has lower flexural rigidity, and therefore can more easily deform under the weight of the box stacked above.

Figure 6:
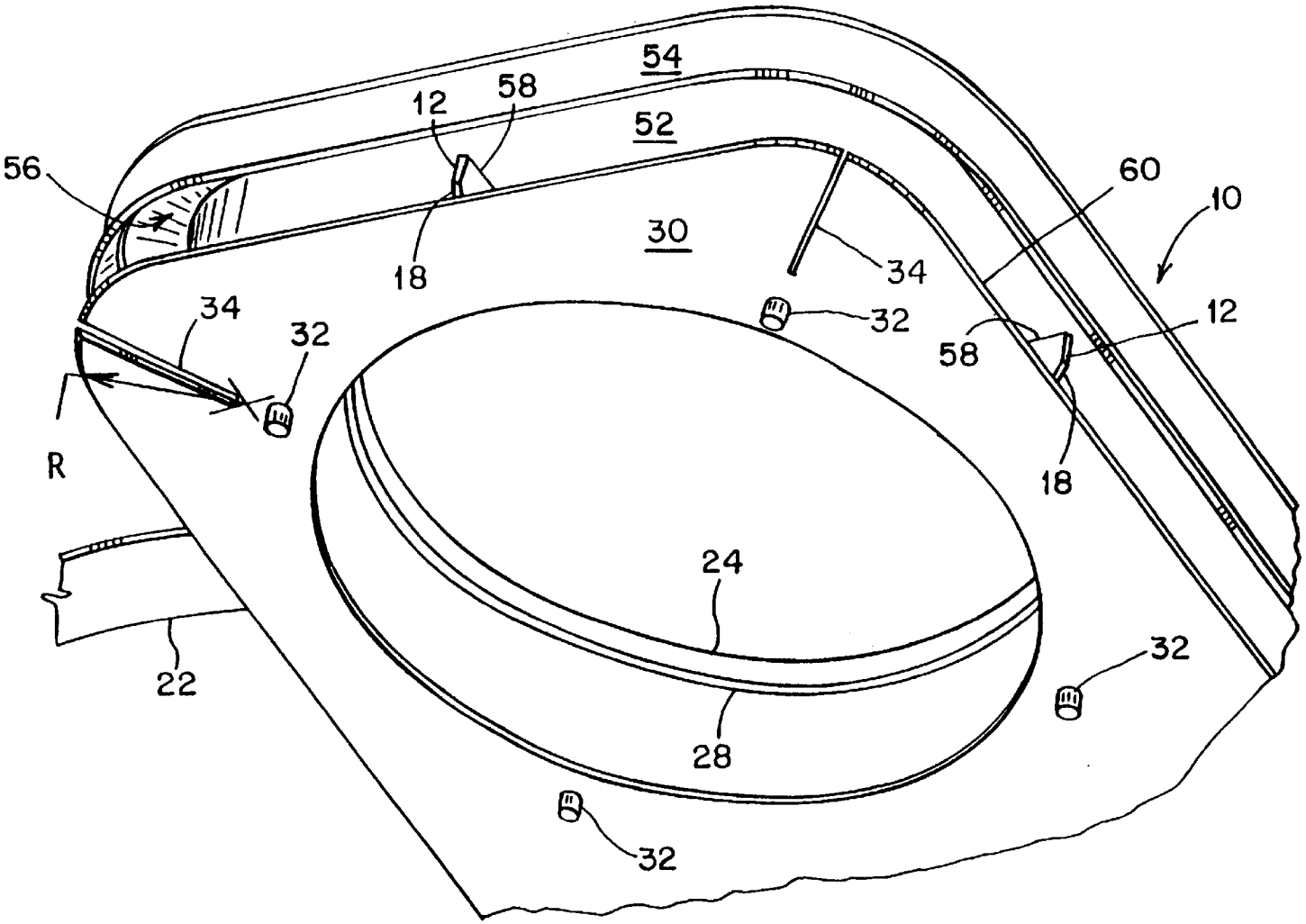
FIG. 6 is a close-up perspective view of the seal of the present invention.

With reference to FIGS. 5 and 6, the present invention can also include a dispensing cover seal 30 to prevent undesirable retention of product by rolled-in lip 16. Seal 30 may be formed of a suitable flexible material. Seal 30 is preferably secured to main portion 50, and has an outer perimetric seal edge 60 which sealingly abuts the continuous upstanding drum wall 44 when dispensing cover 10 is inserted in the first fiberboard drum 14. Seal 30 is positioned to impede retention, by the rolled-in lip 16, of product contained in the first fiberboard drum 14.

In one preferred form of the invention, main portion 50 has a bottom face 62. Barb 12 preferably extends no lower than bottom face 62. Dispensing cover seal 30 is preferably a generally planar sheet having an upper surface 64 secured to bottom face 62 of main portion 50. Seal 30 may be secured to bottom face 62 of main portion 50 by any suitable means, for example, projections 32 can be provided on bottom face 62 of main portion 50 and seal 30 may be provided with holes which receive the projections 32. Any suitable pattern of projections 32 can be used to prevent bowing of seal 30. Seal 30 is preferably formed of about 0.015 inch (about 0.38 mm) polystyrene sheet stock and is stamped via a die-cutting operation. Styrene is preferred for pet food applications, and for similar generally inert materials. PET (polyethylene terephthalate) is preferred for fertilizer and herbicide products. The remainder of cover 10 is preferably formed of colored polypropylene in a thickness of, for example, about 0.070 inches (about 1.8 mm). It is to be understood, however, that any suitable materials and thickness may be used for the cover and seal. Seal 30 can be fastened to projections 32 by welding, gluing, or any other suitable technique; heat sealing of projections 32 is especially preferred.

Angled slits 34 may be formed in seal 30 to aid in flexible engagement of seal 30 with first fiberboard drum 14. Slits 30 are especially desirable when continuous upstanding drum wall 44 forms a generally rectangular tube with rounded corners, as shown in the figures; in this case, dispensing cover seal 30 is preferably also generally rectangular with rounded corners, as also shown in the figures. Thus, angled slits 34 are preferably formed in the rounded corners of the dispensing cover seal 30 to aid in the flexible engagement of dispensing cover seal 30 with first fiberboard drum 14. It should be understood that the cross section of the cover 10 and fiberboard drum 14, 36 may be round, elliptical, or any other desirable shape rather than generally rectangular.

Figure 7:
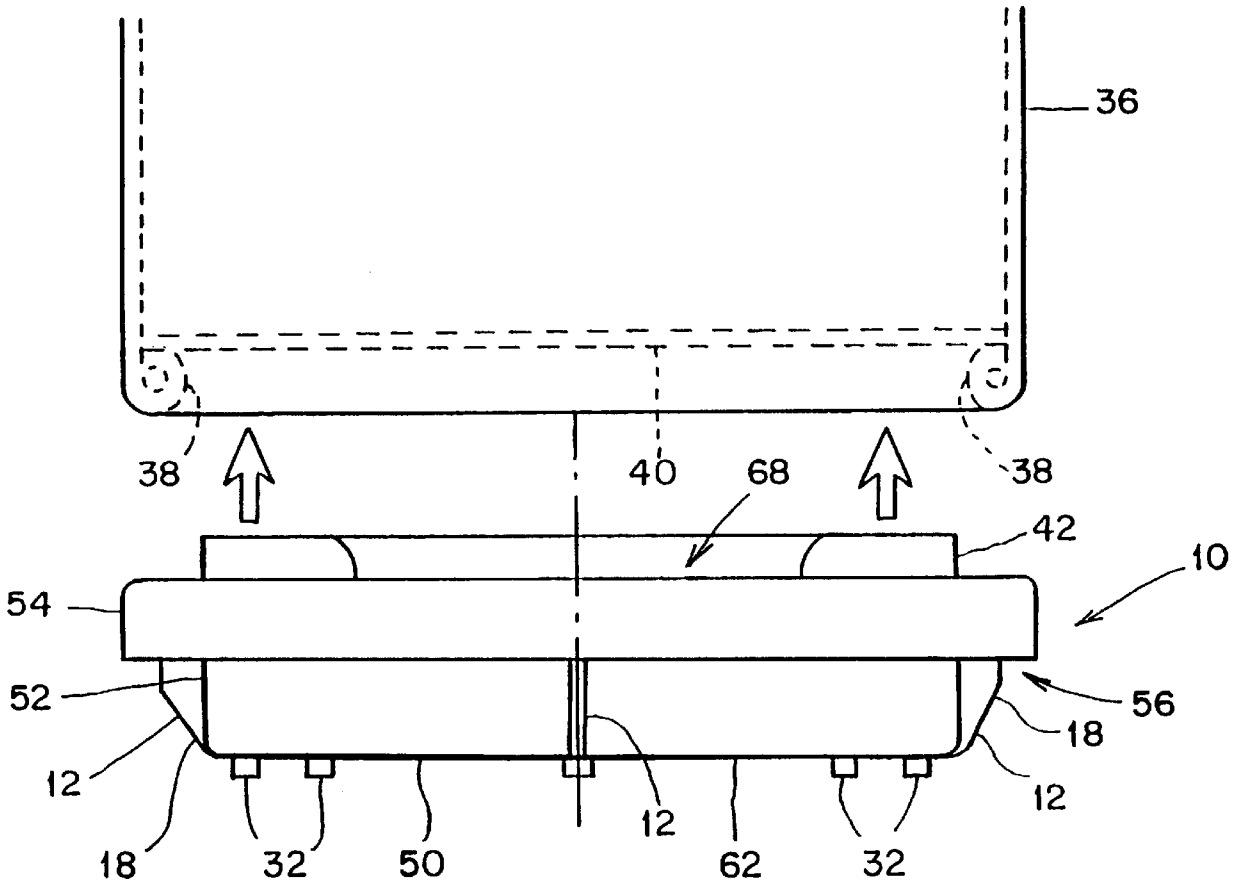
FIG. 7 is a view of a container and cover assembly according to the present invention, showing the stacking feature.
Figure 8:
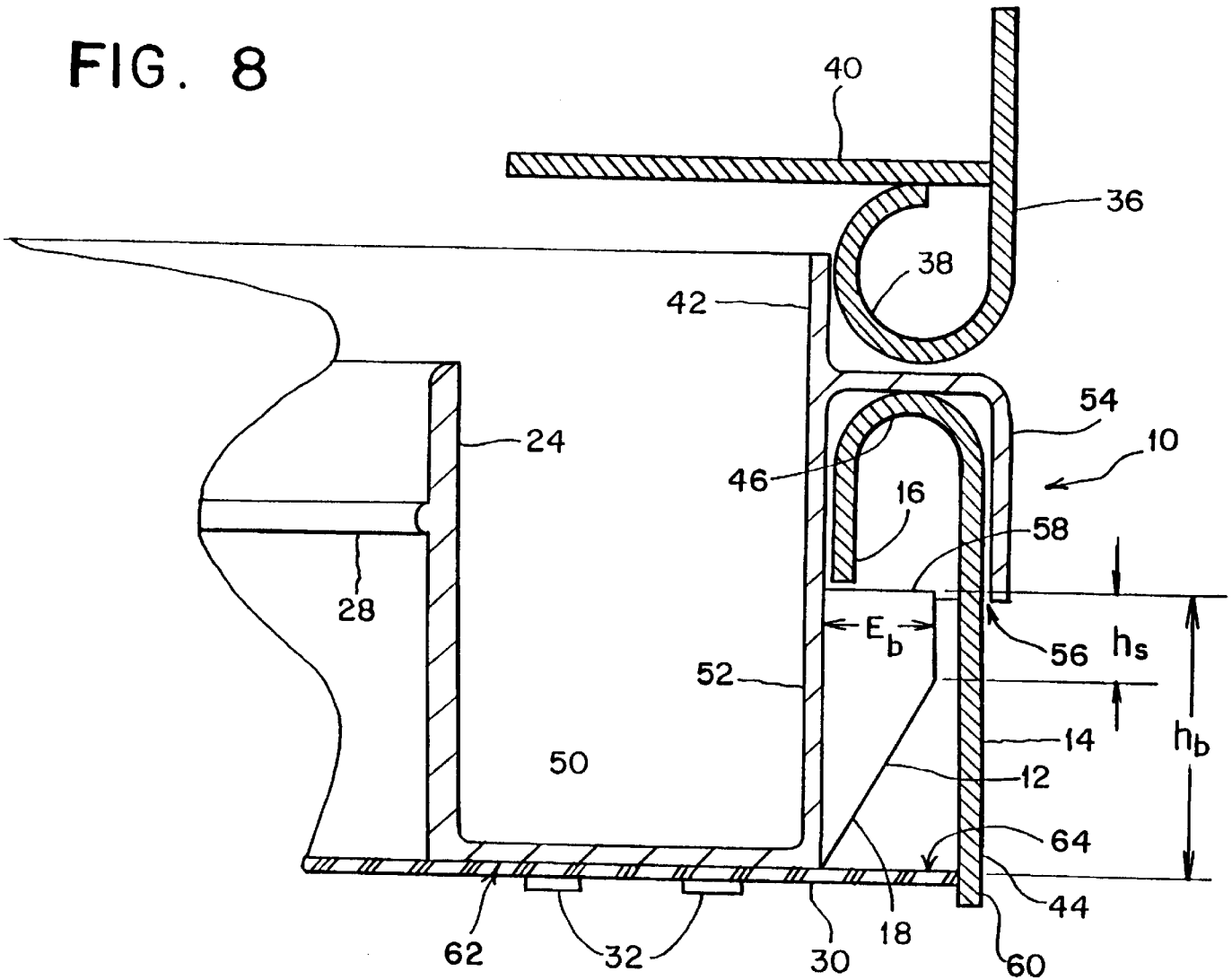
FIG. 8 is a partial, detailed cross-sectional view including the stacking feature.

Reference should now be had to FIGS. 7 and 8. Dispensing cover 10 can, if desired, be configured for self-stacking. In particular, cover 10 can be configured for self-stacking use with a second fiberboard drum (adjacent box) 36 which has a recessed floor 40 retained by rolled-in edges 38. In this case, dispensing cover 10 can be formed with a stack alignment lip 42 which extends upwardly from main portion 50 to engage the rolled-in edges 38 of second fiberboard drum 36 when second fiberboard drum 36 is stacked on top of dispensing cover 10. Referring back briefly to FIG. 1, stack alignment lip 42 can be formed with a first cutout 66 to clear strap 22 and a second cutout 68 for purposes of providing clearance when pouring product out of the aperture of projection 24.

Stack alignment lip 42, as shown in the figures, is preferably formed as a vertical extension of skirt portion 52. Stack alignment lip 42 eliminates the need for a corrugated sheet between adjacent layers of stacked containers, and thereby achieves a cost savings. It is to be understood that the above-discussed features of the barb 12, dispensing cover seal 30, stack alignment lip 42 and resealable lid 20 can all be provided individually with cover 10, or in any combination. Further, it is to be understood that the present invention can also comprise the combination of a dispensing cover 10 in accordance with the present invention with first fiberboard drum 14, and, if desired, second fiberboard drum (or adjacent box) 36. Note that lid 20 and strap 22 are omitted from FIG. 7 for clarity.

With reference to FIG. 3, the overall length of the cover L can be, for example, about 10.85 inches (about 27.6 cm); the width W can be, for example, about 5.655 inches (about 14.4 cm); and the distance X from the outside of the stack alignment lip 42 to the edge of the skirt portion extension 54 can be about 0.485 inches (about 12.3 mm). Referring to FIG. 4, the height H of the skirt portion extension 54 can be about 0.5 inches (about 12.7 mm). With reference to FIG. 8, barb 12 can extend a distance $E_b$ of about 0.261 inches (about 6.6 mm) beyond skirt portion 52. Barb 12 can have an overall height $h_b$ of roughly 0.63 inches (roughly 16 mm) with a height $h_s$ for the non-angled portion of the outer edge of about 0.2 inches (about 5 mm). Barbs 12 can have any convenient thickness; for example, the thickness used for the remainder of the molding, such as about 0.04–0.07 inches (about 1–1.8 mm). Finally, with reference to FIG. 4, stack alignment lip 42 can extend above skirt portion extension 54 by a height $H_{lip}$ of about 0.25 inches (about 6 mm). It is to be understood that all dimensions used herein are exemplary and can be varied to any suitable value for a given application. Referring to FIG. 6, seal 30 can have rounded corners with a radius R of approximately 1 inch (approximately 25.4 mm), generally conforming to the radii on the remainder of the dispensing cover. Slots 34 can extend at about a 45 degree angle for length equal to the full radius, as shown in FIG. 6, or can, for example, extend only half the radius, that is, say about ½ inch (about 13 mm) from the edge of the seal 30. Radial slots 34 can have a width of, for example, about 0.030 inches (about 0.8 mm).

Figure 1:
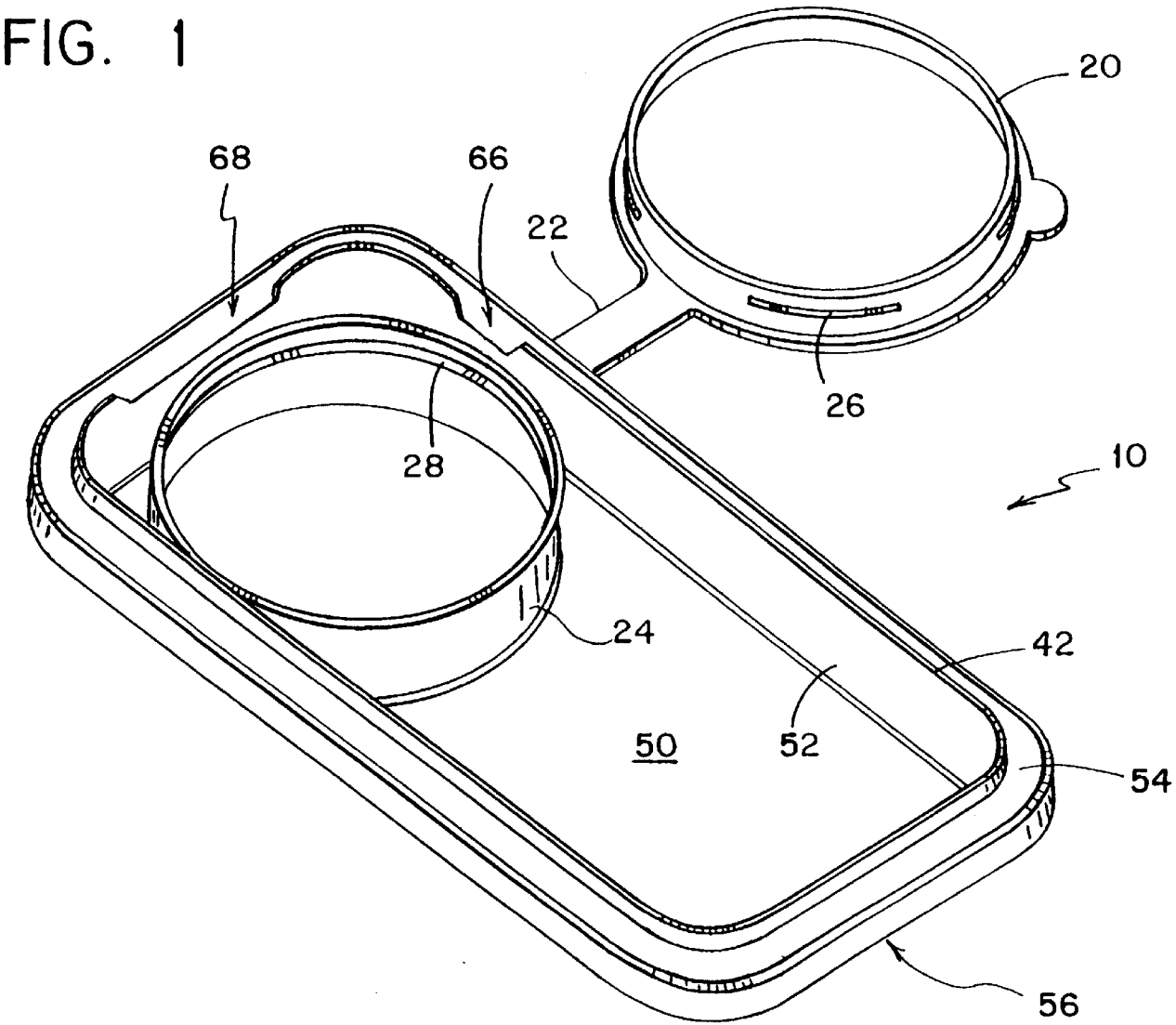
FIG. 1 is a top perspective view of a dispensing cover in accordance with the present invention.
Figure 2:
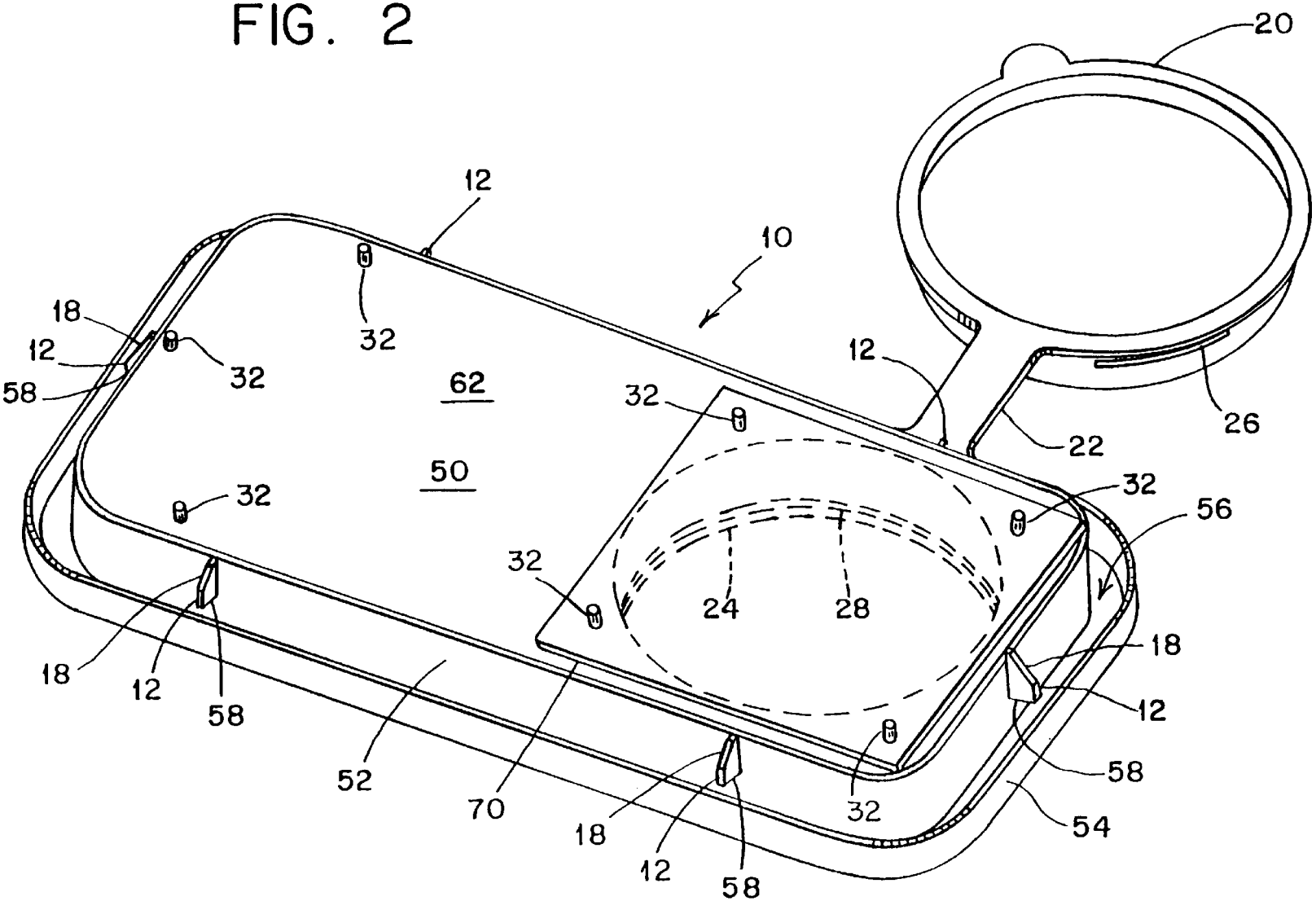
FIG. 2 is a bottom perspective view of a dispensing cover in accordance with the present invention.

As shown in FIG. 2, the present invention can optionally include a tamper evident seal sheet 70. Sheet 70 can be made of, for example, polyester film kraft paper which can be heat sealed, for example, to the main portion 50. Holes can be provided in tamper evident seal sheet 70 to receive projections 32. Dispensing cover seal 30 can then be positioned over projections 32, such that tamper evident seal 70 is sandwiched between main portion 50 and dispensing cover seal 30. Seal sheet 70 can be used in any embodiment of the invention, even those which do not employ dispensing cover seal 30. A user of the cover will preferably receive the cover in place on a fiberboard drum containing product and will note the tamper evident seal sheet 70 in place under the lid 20, verifying that no tampering has taken place with the product in the fiberboard drum. Note that seal sheet 70 has been shown only in FIG. 2 and omitted from the other figures for clarity. Note also that sheet 70 is shown extending beyond the radiused edges of main portion 50; if desired, sheet 70 can instead be configured to lie solely within the perimeter of main portion 50.

Although illustrative embodiments of the present invention have been described herein with reference to the accompanying drawings, it is to be understood that the invention is not limited to those precise embodiments and that various other changes and modifications may be effected therein by one skilled in the art without departing from the scope or spirit of the invention.

What is claimed is:

1. A dispensing cover for use with a first fiberboard drum, the first fiberboard drum having a continuous upstanding drum wall with a wall edge having a rolled-in lip, the wall edge forming a perimeter of a cover-receiving opening, said dispensing cover comprising:

a main portion sized to fit within the perimeter of the cover-receiving opening;

a skirt portion which is secured to said main portion and which extends generally parallel to the upstanding drum wall;

a skirt portion extension which is secured to said skirt portion and which forms a cavity for receiving the rolled-in lip of the first fiberboard drum; and at least one barb which is secured to said skirt portion and which extends outwardly therefrom, said barb having an angled surface which rides up and over the rolled-in lip of the first fiberboard drum as said dispensing cover is inserted in the first fiberboard drum, said barb having a generally straight surface which traps the rolled-in lip of the first fiberboard drum in said cavity of said skirt portion extension when said dispensing cover is fully inserted in the first fiberboard drum, said generally straight surface and said rolled-in lip of the first fiberboard drum interacting to permanently attach said dispensing cover to said first fiberboard drum.

2. A dispensing cover as defined in claim 1, wherein said main portion is formed with a lid-receiving aperture, further comprising a lid which is configured to be resealably secured in said aperture.

3. A dispensing cover as defined in claim 1, further comprising a dispensing cover seal formed of a flexible material, said seal being secured to said main portion, said seal having an outer perimetric seal edge which sealingly abuts the continuous upstanding drum wall when said dispensing cover is inserted in the first fiberboard drum, said seal being positioned to impede retention, by the rolled-in lip, of product contained in the first fiberboard drum.

4. A dispensing cover as defined in claim 3, wherein:

said main portion has a bottom face;

said barb extends no lower than said bottom face; and said dispensing cover seal is a generally planar sheet having an upper surface secured to said bottom face of said main portion.

5. A dispensing cover as defined in claim 4, further comprising a tamper evident seal sheet interposed between said dispensing cover seal and said bottom face of said main portion to initially seal said lid-receiving aperture.

6. A dispensing cover as defined in claim 4, wherein:

the continuous upstanding drum wall forms a generally rectangular tube with rounded corners;

said dispensing cover seal is generally rectangular with rounded corners; and said dispensing cover seal is formed with angled slits in said rounded corners to aid in flexible engagement of said dispensing cover seal with the first fiberboard drum.

7. A dispensing cover as defined in claim 3, wherein said main portion is formed with a lid-receiving aperture, further comprising a lid which is configured to be resealably secured in said aperture.

8. A dispensing cover as defined in claim 3, for stacking use with a second fiberboard drum having a recessed floor retained by rolled-in edges, said dispensing cover further comprising:

a stack alignment lip extending upwardly from said main portion to engage the rolled-in edges of the second fiberboard drum when the second fiberboard drum is stacked on top of said dispensing cover.

9. A dispensing cover as defined in claim 8, wherein said stack alignment lip is formed as a vertical extension of said skirt portion.

10. A dispensing cover as defined in claim 8, wherein said main portion is formed with a lid-receiving aperture, further comprising a lid which is configured to be resealably secured in said aperture.

11. A dispensing cover for use with a first fiberboard drum, the first fiberboard drum having a continuous upstanding drum wall with a wall edge having a rolled-in lip, the wall edge forming a perimeter of a cover-receiving opening, said dispensing cover comprising:

a main portion sized to fit within the perimeter of the cover-receiving opening;

a skirt portion which is secured to said main portion and which extends generally parallel to the upstanding drum wall;

a skirt portion extension which is secured to said skirt portion and which forms a cavity for receiving the rolled-in lip of the first fiberboard drum; and a dispensing cover seal formed of a flexible material, said seal being secured to said main portion, said seal having an outer perimetric seal edge which sealingly abuts the continuous upstanding drum wall when said dispensing cover is inserted in the first fiberboard drum, said seal being positioned to impede retention, by the rolled-in lip, of product contained in the first fiberboard drum.

12. A dispensing cover as defined in claim 11, wherein:

said main portion has a bottom face; and said dispensing cover seal is a generally planar sheet having an upper surface secured to said bottom face of said main portion.

13. A dispensing cover as defined in claim 12, wherein:

the continuous upstanding drum wall forms a generally rectangular tube with rounded corners;

said dispensing cover seal is generally rectangular with rounded corners; and said dispensing cover seal is formed with angled slits in said rounded corners to aid in flexible engagement of said dispensing cover seal with the first fiberboard drum.

14. A dispensing cover as defined in claim 11, wherein said main portion is formed with a lid-receiving aperture, further comprising a lid which is configured to be resealably secured in said aperture.

15. A dispensing cover as defined in claim 11, for stacking use with a second fiberboard drum having a recessed floor retained by rolled-in edges, said dispensing cover further comprising:

a stack alignment lip extending upwardly from said main portion to engage the rolled-in edges of the second fiberboard drum when the second fiberboard drum is stacked on top of said dispensing cover.

16. A dispensing cover as defined in claim 15, wherein said main portion is formed with a lid-receiving aperture, further comprising a lid which is configured to be resealably secured in said aperture.

17. A dispensing cover for use with a first fiberboard drum and for stacking use with a second fiberboard drum, the first fiberboard drum having a continuous upstanding drum wall with a wall edge having a rolled-in lip, the wall edge forming a perimeter of a cover-receiving opening, the second drum having a recessed floor retained by rolled-in edges, said dispensing cover comprising:

a main portion sized to fit within the perimeter of the cover-receiving opening;

a skirt portion which is secured to said main portion and which extends generally parallel to the upstanding drum wall;

a skirt portion extension which is secured to said skirt portion and which forms a cavity for receiving the rolled-in lip of the first fiberboard drum;

at least one barb which is secured to said skirt portion and which extends outwardly therefrom, said barb having an angled surface which rides up and over the rolled-in lip of the first fiberboard drum as said dispensing cover is inserted in the first fiberboard drum, said barb having a generally straight surface which traps the rolled-in lip of the first fiberboard drum in said cavity of said skirt portion extension when said dispensing cover is fully inserted in the first fiberboard drum, said generally straight surface and said rolled-in lip of the first fiberboard drum interacting to permanently attach said dispensing cover to said first fiberboard drum; and a stack alignment lip extending upwardly from said main portion to engage the rolled-in edges of the second fiberboard drum when the second fiberboard drum is stacked on top of said dispensing cover.

18. A dispensing cover as defined in claim 17, wherein said stack alignment lip is formed as a vertical extension of said skirt portion.

19. A dispensing cover as defined in claim 17, wherein said main portion is formed with a lid-receiving aperture, further comprising a lid which is configured to be resealably secured in said aperture.

* * * * *